United States Patent [19]

Wedding

[11] Patent Number: 4,507,715

[45] Date of Patent: Mar. 26, 1985

[54] POST LIGHT

[76] Inventor: Paul W. Wedding, Rte. #1, Box 564, Bokeelia, Fla. 33922

[21] Appl. No.: 522,327

[22] Filed: Aug. 11, 1983

[51] Int. Cl.[3] ..... F21S 1/02

[52] U.S. Cl. ..... 362/153; 362/145; 362/267; 362/311; 362/431

[58] Field of Search ..... 362/153, 145, 311, 267, 362/431

[56] References Cited

U.S. PATENT DOCUMENTS

| | | | |
|---|---|---|---|
| 1,807,413 | 5/1931 | King | 362/431 |
| 4,004,144 | 1/1977 | Chako | 362/432 |

*Primary Examiner*—Stephen J. Lechert, Jr.
*Attorney, Agent, or Firm*—Claude A. Patalidis

[57] ABSTRACT

A post light having an upstanding elongate main body portion of decorative appearance, preferably made of concrete and having a hollow interior in which is lengthwise disposed a weather impervious tubular conduit. An annular member is attached on top of the tubular conduit and supports a light bulb socket, the wiring from the light bulb socket to an electrical junction box passing through the annular member and being disposed on the interior of the tubular member. A seal is disposed between the light bulb socket and the annular member. A light fixture surrounds the light bulb socket and a removable finial is supported from the top of the main body portion by spaced apart support members. The resulting post light structure is strong and sturdy, substantially weatherproof, and of highly decorative appearance.

9 Claims, 6 Drawing Figures

FIG. 1
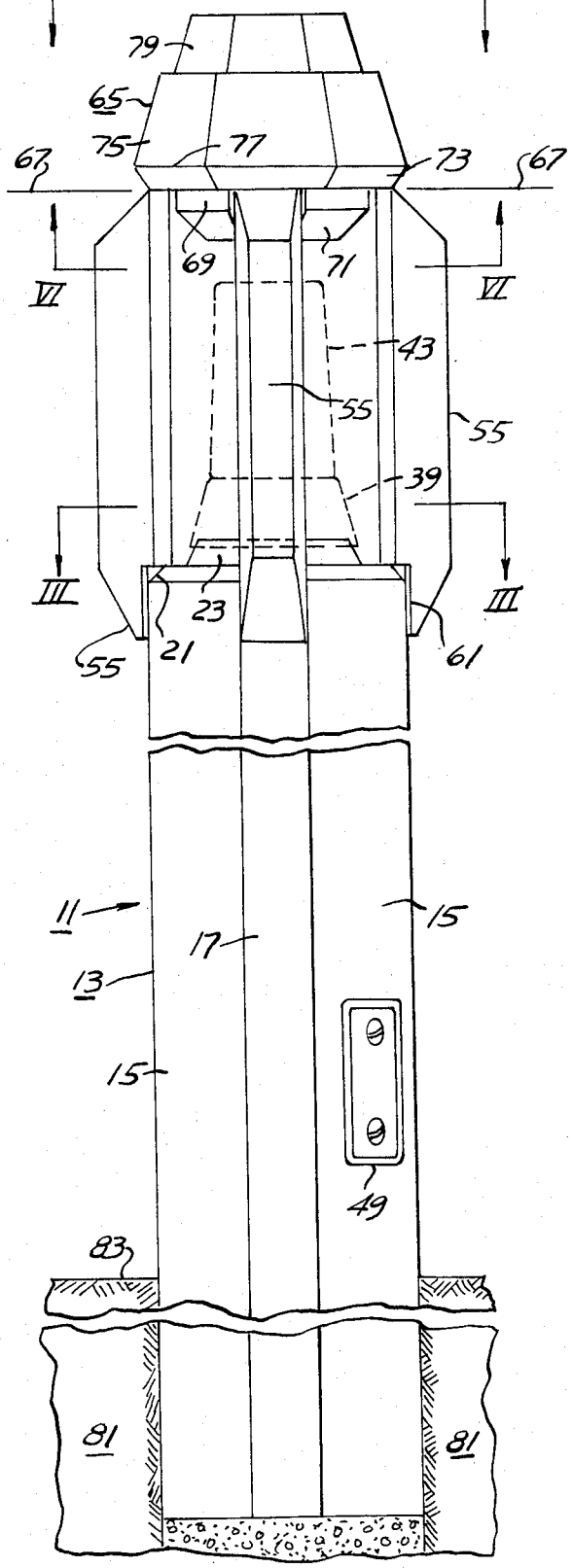
FIG. 5
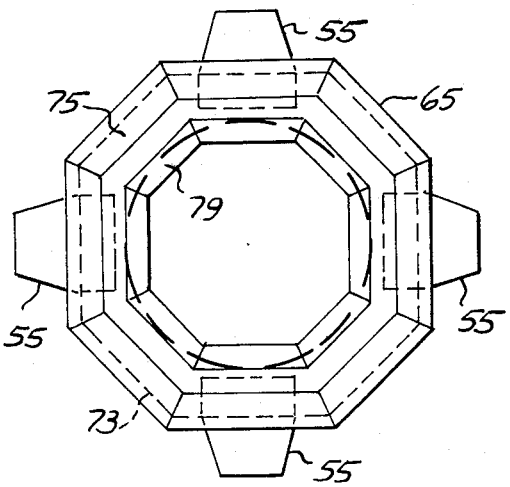
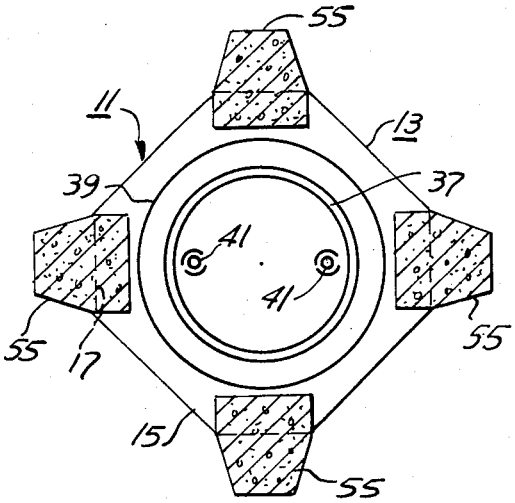
FIG. 3

POST LIGHT

BACKGROUND OF THE INVENTION

The present invention relates generally to lights, and more particularly, to decorative and functional outdoor lights of the kind usually installed in front of homes and some business establishments. Such lights are known as post lights and there are many kinds and types of such lights. Some such post lights are made of wood and these have a tendency to rot when set into wet and soggy ground. Even the upper, above-ground portion of such post lights tend to rot due to exposure to the weather elements.

Construction of a post light that is both decorative and functional, and that will not deteriorate under weather conditions that cause rotting in wooden post lights is a principal objective of the present invention. The post light of the present invention is constructed of concrete with plastic and like materials that may be exposed to the weather elements.

SUMMARY OF THE INVENTION

A post light in accordance with the invention includes an elongate main body member having an elongate tubular conduit extending lengthwise thereof, with an electric bulb socket fixed atop the main body portion and electric wires within the conduit connecting the socket to an electric junction box carried by the main body portion. An electrical light fixture surrounds the light bulb, and a removable finial is supported above the light fixture by elongate members carried by the sides of the main body portion.

For a further understanding of the invention, and for features and advantages thereof, reference may be made to the following description taken with the drawings showing one embodiment of the present invention.

BRIEF DESCRIPTION OF THE DRAWING

In the drawing:

FIG. 1 is a schematic view in elevation of one embodiment of a post light in accordance with the invention;

FIG. 3 is a view along line III—III of FIG. 1;

FIG. 5 is a view along V—V of FIG. 1; and

DETAILED DESCRIPTION

Referring to FIG. 1, a post light 11 in accordance with the invention includes an elongate main body portion 13 having four large flat sides 15 and four smaller flat sides 17, arranged like an octagon as shown in FIG. 3.

Figure 2:
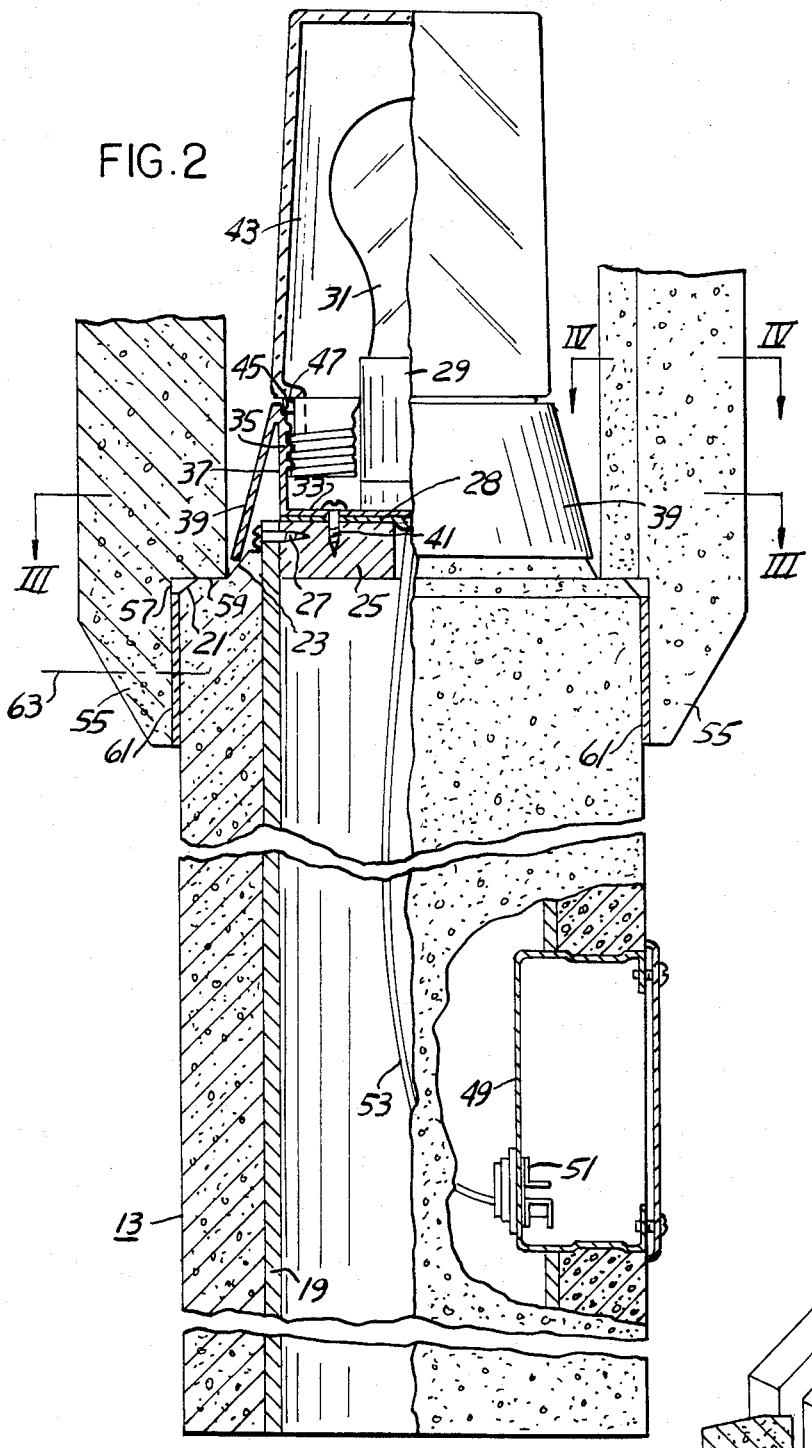
FIG. 2 is a view of a portion of the post light of FIG. 1 showing details thereof.

Centrally disposed in the main body portion 13 and extending longitudinally thereof is a tubular conduit 19 preferably of plastic such as PVC pipe extending slightly above the top of the main body portion 13, as shown in FIG. 2.

The upper top edge of the main body portion 13 is chamfered as at 21, and inwardly from the chamfered edge 21 is an upwardly raised portion 23 surrounding the tubular member 19.

Within the top of the tubular conduit 19 is an annular wooden member 25 that is held in place by screw fasteners 27 extending through the tubular conduit 19. On top of the wooden member 25 is a layer of compressed fiber glass, or the like, 28 and supported upon such fiber glass 28 is a light bulb socket 29 of conventional make and kind in which a conventional light bulb 31 is installed.

The light bulb socket 29 is set on the bottom portion of a holder 33 having internal threads 35 on a vertical wall portion 37. The vertical wall portion 37 merges at the top with a downwardly and outwardly flared weather shield 39 that contacts the upwardly sloping raised top portion 23. The holder 33 is secured to the annular wooden member 25 by means of screw fasteners 41.

A threaded light bulb fixture 43 of conventional kind and style is received in the threaded portion 35 and surrounds the light bulb 31, as shown in FIG. 2. Between the light bulb fixture 43 and a shoulder 45 of the vertical wall 37, there is a resilient sealing ring 47.

Near the bottom of the main body portion 13, in one of the larger flat sides 15, there is a conventional electrical junction box 49 with a conventional electric connector 51 therein to receive an end of an electrical cable (not shown) that carries electrical current to the junction box 49. The electrical connector 51 is connected to electric wiring 53 extending upwardly within the conduit 19 to the light bulb socket 29.

Figure 4:
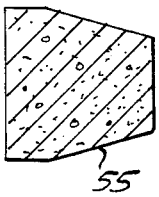
FIG. 4 is a view along line IV—IV of FIG. 2.
Figure 6:
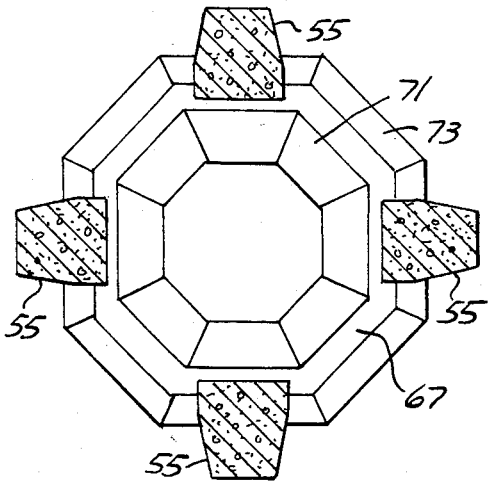
FIG. 6 is a view along line VI—VI of FIG. 1.

Symetrically arranged around the top portion of the main body portion 13 are four elongate spreaders 55, each one of which is trapezoidal in cross section, as shown in FIG. 4. The spreaders 55 are recessed at one end, as at 57, to rest on the top flat surface 59 of the main body portion 13. The lower portion of each spreader 55 abuts the smaller flat side 17, and each spreader 55 is held in the vertical position by means of an epoxy adhesive 61 between the spreader 55 and the smaller flat side 17, and by a suitable fastener 63 extending through the spreader into the main body portion 13.

The upper ends of the spreaders 55 support a removable finial 65 having an octagonal shape generally, as shown in FIG. 5. The finial 65 comprises a plurality of geometric shaped units arranged above and below a plane at the top of the spreaders 55, such plane being designated as 67.

The first geometric shaped unit below such plane 67 is a vertical sided octagon 69. Beneath this octagonal shaped unit 69 is an inverted truncated octagonal pyramid 71. Above the plane 67 is a first, inverted octagonal pyramidal unit 73 which is surmounted by a truncated octagonal pyramidal unit 75 having a base 77 that is the same size as the base of the truncated pyramid 73. On top of the truncated octagonal pyramid unit 75 is a smaller truncated octagonal pyramidal unit 79. The pyramidal units have common faying surfaces where they abut each other.

In use, the main body portion 13 is set into the ground 81 so that the ground level 83 is a nominal distance below the junction box 49. After the electrical wiring is connected to the junction box and the wiring within the tubular conduit is connected to the connector and the light bulb socket, the light fixture may be installed and the finial set on top of the spreaders. If desired, a weather proof switch may be installed on the main body portion in a known manner to control the light locally.

From the foregoing description of one embodiment of the present invention, those skilled in the art will recognize many features and advantages of it, among which the following are:

That the post light, being made preferably of concrete, is resistant to weather induced rot and decay as are decorative wooden post lights of the prior art;

That the post light is weatherproof to weather elements;

That the post light may be made of concrete of any preferred color; and

That the post light is simple to construct and is practically indestructible.

Although the invention as set forth in the foregoing description and in the drawing has been described with a certain degree of particularity, it is understood that other modifications may be made thereto without departing from the scope thereof as defined by the following claims.

I claim:

1. A post light comprising an upstanding elongate main body portion of decorative appearance having a bottom end attached to the ground and a top end, said elongate main body portion having a hollow interior, a substantially weather impervious tubular conduit extending lengthwise of said main body portion and lining the hollow interior thereof, and tubular conduit extending at least to the top end of said main body portion, an annular member attached on top of said tubular conduit, a light bulb socket mounted on top of said annular member, sealing means disposed between said light bulb socket and said annular member, an electrical junction box affixed to said main body portion, electrical wires disposed within said tubular conduit and through said annular member for connecting said light bulb socket to said junction box, a light fixture removably mounted on top of said main body portion and surrounding said light bulb socket, a plurality of spaced apart support members disposed around said light fixture and having each a base attached to the top of said main body portion, said support members upwardly extending from the top of said main body portion to beyond the top of said light fixture, said support members being of decorative appearance and forming openings therebetween uncovering said light fixture, and a decorative finial removably disposed on top of said support members above said light fixture.

2. The post light of claim 1 wherein said main body portion is made of concrete.

3. The post light of claim 1 wherein said tubular conduit is a plastic pipe.

4. The post light of claim 2 wherein said tubular conduit is a plastic pipe.

5. The post light of claim 1 wherein said junction box is embedded in said main body portion proximate the bottom end thereof.

6. The post light of claim 1 wherein said main body portion is substantially octagonal.

7. The post light of claim 2 wherein said main body portion is substantially octagonal.

8. The post light of claim 3 wherein said main body portion is substantially octagonal.

9. The post light of claim 4 wherein said main body portion is substantially octagonal.

* * * * *

UNITED STATES PATENT AND TRADEMARK OFFICE

CERTIFICATE OF CORRECTION

PATENT NO. : 4,507,715

DATED : March 26, 1985

INVENTOR(S) : Paul W. Wedding

It is certified that error appears in the above-identified patent and that said Letters Patent are hereby corrected as shown below:

Col. 1, line 48, after "along" insert --line--.

Col. 3, line 23, change "and" to --said--.

Signed and Sealed this

*Ninth* Day of *July 1985*

[SEAL]

*Attest:*

DONALD J. QUIGG

*Attesting Officer* *Acting Commissioner of Patents and Trademarks*